US010188149B2

(12) United States Patent
Berkowitz et al.

(10) Patent No.: US 10,188,149 B2
(45) Date of Patent: Jan. 29, 2019

(54) PLACKET TRUSS AND GARMENT INCORPORATING THE SAME

(76) Inventors: Stacey Beth Berkowitz, Lakewood, CO (US); John Wray Carpenter, Lakewood, CO (US)

( * ) Notice: Subject to any disclaimer, the term of this patent is extended or adjusted under 35 U.S.C. 154(b) by 1378 days.

(21) Appl. No.: 13/099,359

(22) Filed: May 3, 2011

(65) Prior Publication Data

US 2012/0278973 A1 Nov. 8, 2012

(51) Int. Cl.
*A41B 1/10* (2006.01)
*A41F 1/00* (2006.01)

(52) U.S. Cl.
CPC ..... *A41B 1/10* (2013.01); *A41D 2300/30* (2013.01); *A41F 1/00* (2013.01)

(58) Field of Classification Search
CPC .. A41F 1/00; A41F 9/025; A41F 1/006; A41F 15/02; A41F 3/00; A41F 9/002; A41F 9/02; A41F 15/002; A41F 17/04; A41F 11/00; A41F 11/14; A41F 13/00; A41F 15/00; A41F 15/005; A41F 15/007; A41F 17/00; A41F 19/00; A41F 17/02; A41F 19/005; A41F 9/00; A41F 9/007
USPC ..... 2/336, 255, 145, 49, 115; 3/336
See application file for complete search history.

(56) References Cited

U.S. PATENT DOCUMENTS

| | | | | |
|---|---|---|---|---|
| 153,444 | A * | 7/1874 | Maurer | 2/120 |
| 1,098,638 | A * | 6/1914 | Rees | 2/302 |
| 2,636,235 | A * | 4/1953 | Nygard | 24/110 |
| 3,381,865 | A * | 5/1968 | Pehr | 223/87 |
| 3,717,908 | A * | 2/1973 | Perina | 24/444 |
| 5,337,457 | A * | 8/1994 | Chennault | 24/66.4 |
| 6,435,940 | B1 * | 8/2002 | Fildan et al. | 450/86 |
| 7,785,171 | B1 * | 8/2010 | Baker | 450/86 |
| 8,153,221 | B1 * | 4/2012 | MacKinnon | 428/40.1 |
| 2007/0028368 | A1 | 2/2007 | Morton | |
| 2007/0044198 | A1 * | 3/2007 | Whicker | 2/69 |
| 2011/0173740 | A1 * | 7/2011 | Franklin | 2/255 |

* cited by examiner

*Primary Examiner* — Alissa L Hoey
*Assistant Examiner* — Catherine M Ferreira
(74) *Attorney, Agent, or Firm* — Perkins Coie LLP

(57) ABSTRACT

A placket truss comprising an elongate member including opposed end portions, wherein each of the end portions includes at least one slot sized and adapted to engage the thread of a corresponding button. Each end portion may include a clip, wherein each clip includes at least one slot and the elongate member is adapted to confront the back side of the placket. The slot or slots may extend in the same direction as a length of the elongate member. Alternatively, the slot or slots may extend in a direction transverse to a length of the elongate member. Each clip is adapted to confront the front side of the placket whereby each of the clips is capable of grasping the placket. The elongate member may comprise a strip of resilient material and may be substantially flat.

19 Claims, 4 Drawing Sheets

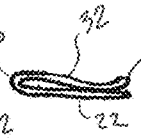
FIG. 6
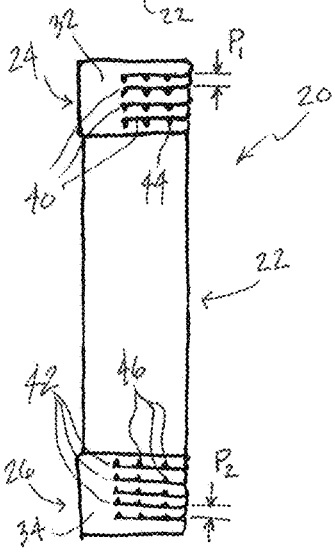
FIG. 5
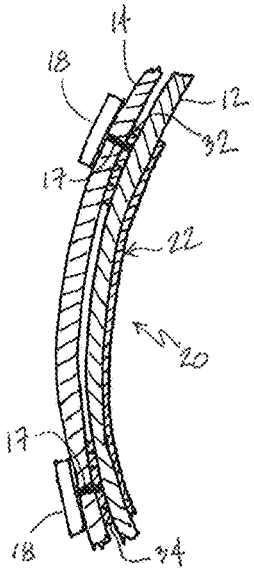
FIG. 8
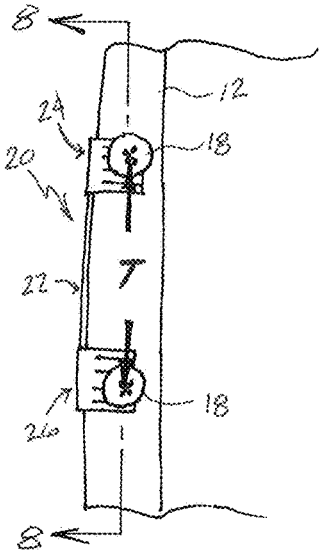
FIG. 7
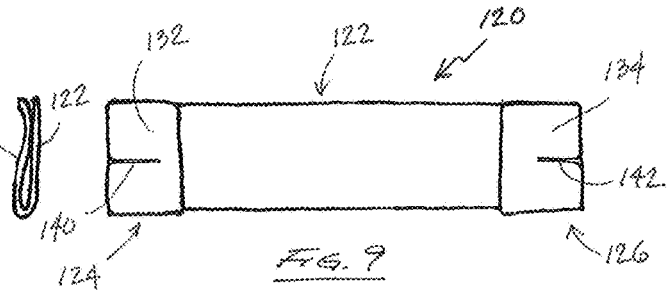
FIG. 10
FIG. 9
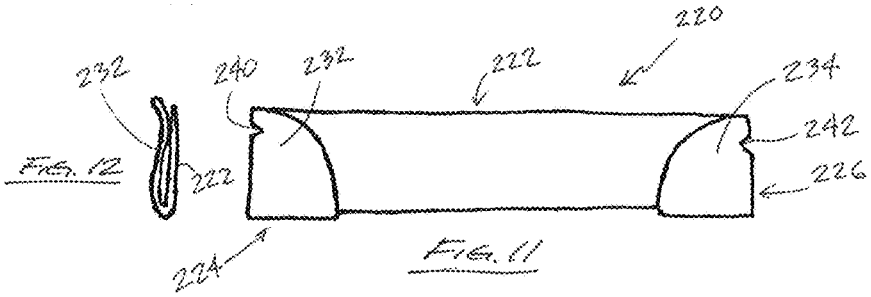
FIG. 12
FIG. 11

PLACKET TRUSS AND GARMENT INCORPORATING THE SAME

BACKGROUND

The nature of some garments requires the formation of a slit opening for conveniently putting the garment on. Such an opening is often comprised of overlapping inner and outer plackets. An example of such a garment is the button-up shirt, in which the plackets ordinarily extend downwardly from a central location at the front of a neck opening. In making such garments, formation of the placket usually involves placement of additional layers of material over the primary fabric layer and/or folding the primary layer back onto itself. Button holes are formed on the outer placket by cutting a slotted opening through the placket in the desired location and sewing along each side of the opening through all of the layers. The inner placket includes a plurality of buttons, usually attached with thread, each of which is aligned with a corresponding button hole.

Buttoned plackets, particularly on the front of a shirt, are prone to gaping. When a shirt is chosen to properly fit a person's shoulders and arm length, for example, the chest portion of the shirt is often too small to accommodate the person's chest without pulling the plackets of the shirt apart, thereby creating a gap. This problem with button down garments is especially troubling for women. A gaping blouse can be a source of embarrassment or unwanted staring. Different bra sizes and styles, such as padded bras, may exacerbate the tightness of a blouse, contributing to the problem.

Others have attempted to address this problem by placing double sided tape between the plackets of clothing prone to gape. Tape provides a temporary solution; however, the tape loses its adhesion over time and may fail during use. Furthermore, the tape is not reusable and a new piece must be used for each garment each time it is worn.

Accordingly, there is a need for a reusable solution to a gaping placket that works with multiple garments with different button spacing. Moreover, there is a need for a solution that is inconspicuous and durable.

SUMMARY

Described herein are various exemplary embodiments of a placket truss for use on a placket that has a front side, with a plurality of buttons sewn thereto with thread, and an opposite back side. In one embodiment, the placket truss comprises an elongate member including opposed end portions, wherein each of the end portions includes at least one slot sized and adapted to engage the thread of a corresponding button. The slots may also include at least one notch adapted to receive the thread of a corresponding button. The elongate member may comprise a strip of flexible, resilient material and may be substantially flat.

The slot or slots may extend in the same direction as a length of the elongate member. Alternatively, the slot or slots may extend in a direction transverse to a length of the elongate member. In another embodiment, some slots may extend transversely to the length while others extend along the length of the elongate member.

In an embodiment, each of the end portions may include a clip, wherein each of the clips includes at least one slot and the elongate member is adapted to confront the back side of the placket. In this embodiment each of the clips is adapted to confront the front side of the placket whereby each of the clips is capable of grasping the placket. The placket truss may further comprise a medial clip disposed between the opposed end portions.

In another embodiment, one of the clips includes a first set of slots spaced apart from each other a selected first pitch and the other clip includes a second set of slots spaced apart from each other a selected second pitch.

Also contemplated is an embeddable placket stiffener for use in a placket having a plurality of fasteners attached thereto. The stiffener comprising a resilient elongate strip sized for placement in the placket. An article of clothing is contemplated that incorporates a placket stiffener. The article of clothing includes a garment including a placket having a folded edge margin and a plurality of fasteners attached thereto. An elongate strip is disposed inside the folded edge margin of the placket. The strip is substantially flat and comprised of a flexible, resilient material.

These and other aspects of the present device and methods will be apparent after consideration of the Detailed Description and Drawings provided herein. It is to be understood, however, that the scope of the invention shall be determined by the claims as issued.

BRIEF DESCRIPTION OF THE DRAWINGS

Non-limiting and non-exhaustive exemplary embodiments, including the preferred embodiment, are described with reference to the following figures, wherein like reference numerals refer to like parts throughout the various views unless otherwise specified.

FIG. 5 is a top plan view of the placket truss shown in FIG. 3;

FIG. 6 is an end view of the placket truss shown in FIG. 5;

FIG. 7 is a top plan view of an inner placket with the placket truss of FIGS. 5 and 6 installed on the placket;

FIG. 8 is a cross sectional view taken about line 8-8 of FIG. 7 further including an outer placket buttoned to the inner placket;

FIG. 9 is a top plan view of a placket truss according to a second exemplary embodiment;

FIG. 10 is an end view of the placket truss shown in FIG. 9;

FIG. 11 is a top plan view of a placket truss according to a third exemplary embodiment;

FIG. 12 is an end view of the placket truss shown in FIG. 11;

DETAILED DESCRIPTION

Embodiments are described below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and combinations thereof and the invention should not be construed as being limited to the embodiments set forth herein. The following detailed description is, therefore, not to be taken in a limiting sense.

Figure 1:
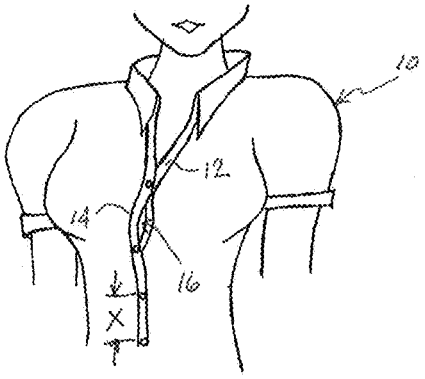
FIG. 1 is a partial perspective view of a woman wearing a blouse with a gaping placket.
Figure 2:
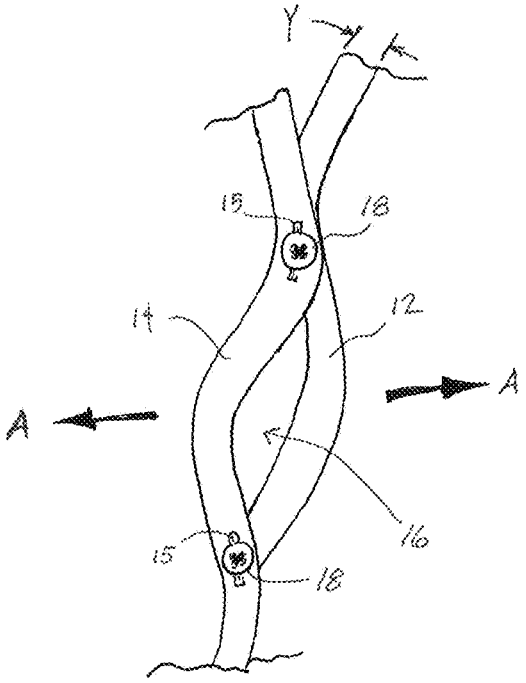
FIG. 2 is an enlarged partial view of the blouse shown in FIG. 1.

FIG. 1 is an illustration of a traditional blouse 10 that includes an inner placket 12 overlapped by an outer placket 14. With further reference to FIG. 2, outer placket 14 includes a plurality of button holes 15, which receive buttons 18 that are attached to inner packet 12. Inner placket 12 has a width Y and button spacing X. FIG. 2 illustrates a gap 16 that is created by tension along arrows A, which in this example, represents the pulling force caused by the chest area of the female torso.

Figure 3:
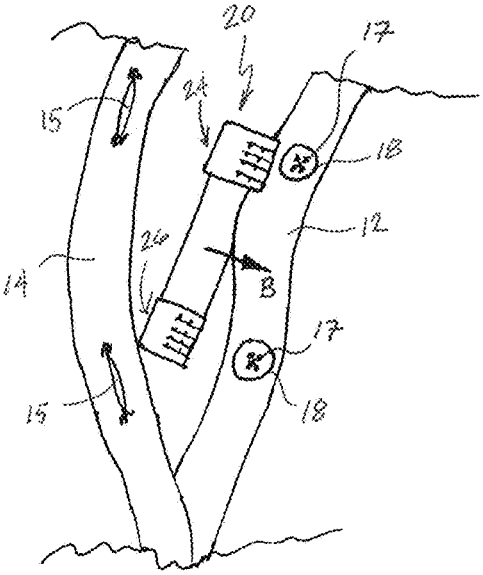
FIG. 3 is an enlarged partial view of the inner and outer plackets of the blouse shown in FIGS. 2 and 3, illustrating the installation of a placket truss according to a first exemplary embodiment.
Figure 4:
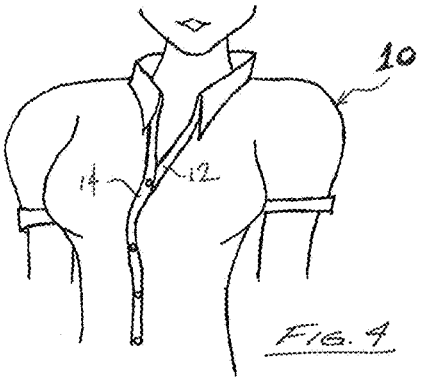
FIG. 4 is a partial perspective view of a woman wearing a blouse with the placket truss shown in FIG. 3 installed.

FIG. 3 illustrates the installation of a placket truss 20 according to a first exemplary embodiment onto inner placket 12. As shown, the blouse is unbuttoned such that placket truss 20 may be clipped onto inner placket 12 in the direction indicated by arrow B. Placket truss 20 includes end portion 24 and opposite end portion 26, each of which is adapted to engage threads 17, as explained below. FIG. 4 illustrates the blouse 10 being worn with the placket truss 20 installed such that inner and outer plackets lie flat with respect to each other, thereby eliminating gap 16.

As shown in FIG. 5, placket truss 20 includes an elongate member 22 including opposed end portions 24 and 26. Wherein each said end portion includes at least one slot sized and adapted to engage the thread of a corresponding button. In this embodiment, end portions 24 and 26 include clips 32 and 34 respectively. Clips 32 and 34 are adapted to grasp inner placket 12 when installed. Referring to FIG. 6, clip 32 extends from elongate member 22 around an arcuate bend 36 and terminates at lip 38. In this case, bend 36 is approximately 180 degrees such that clip 32 doubles back on elongate member 22. It should be appreciated that lip 38 facilitates sliding the clip onto placket 12. Clip 34 has a similar construction as that shown in FIG. 6 with respect to clip 32.

Each clip 32 and 34 includes a set of slots 40 and 42 respectively. In this embodiment, the slots extend transverse to the length of the elongate member 22. Clip 32 includes a plurality of slots 40 which are spaced apart from each other at a pitch $P_1$. Clip 34 includes a plurality of slots 42 which are spaced apart from one another at a pitch $P_2$. Pitch $P_1$ and $P_2$ may be the same; however, spacing the two sets of slots at different pitches creates a wider range of button spacings with which the placket truss will mate. For example, $P_1$ may be 0.050 inches and $P_2$ may be 0.063 inches. Other spacings may be selected as desired to mate with various button spacings. In this case, each slot 40, 44 includes a plurality of notches 44, 46, respectively. Notches 44, 46 engage or receive button threads 17 in order to help keep the placket truss 20 from sliding off placket 12. The notches are spaced along each slot to accommodate different width plackets.

FIG. 7 shows the placket truss 20 installed on inner placket 12 (outer placket 14 is hidden for clarity). FIG. 8 illustrates outer placket 14 buttoned to inner placket 12 with placket truss 20 installed. With reference to FIGS. 7 and 8, it can be appreciated that elongate member 22 confronts the backside of inner placket 12, while clips 32 and 34 confront the front side of inner placket 12. In other words, placket 12 is clamped, or grasped, between elongate member 22 and clips 32 and 34. With specific reference to FIG. 8, clips 32 and 34 are located between inner placket 12 and outer placket 14 while threads 17 align with a corresponding one of slots 40 and 42.

By engaging threads 17 via slots (40, 42) and by grasping placket 12 with clips 32 and 34, the placket truss 20 tensions placket 12 along arrow T, which resists pulling force A described above. It should also be noted that placket truss 20 is flexible at least along elongate member 22 in order to conform to the garment as well as the wearer's body. Elongate member 22 may be pre-formed with a bend, or an arc, as shown in FIG. 8.

The placket truss may be formed of suitable materials that are flexible yet resilient, such as sheet metal or plastic. For example, 0.015 inch thick spring tempered 301 stainless steel is a suitable material to form the above described placket truss. Another suitable material is 0.016 inch thick spring tempered 510 bronze. Other materials include aluminum and plastics such as polycarbonate. Applicable plastics may be opaque or clear. The placket truss according to this embodiment may be formed by traditional metal stamping and forming methods as are known in the art. The truss may also be thermoformed or molded in the case of plastic. The above suggested materials, sizes, and manufacturing methods are for exemplary purposes only and should not be construed as limiting.

FIG. 9 illustrates a placket truss 120 according to a second exemplary embodiment. Placket truss 120 is similar to the first embodiment described above with respect to FIGS. 5-7, except clips 132 and 134 include slots 140 and 142 respectively. In this case, slots 140 and 142 extend in the same direction as the length of the elongate member 122. While placket truss 120 is shown with a single slot in each clip, multiple slots could be included to accommodate different button spacings as well as different placket widths. As shown in FIG. 10, clips 132 and 134 have a similar construction to that described above with respect to clips 32 and 34.

FIGS. 11 and 12 illustrate a placket truss 220 according to a third exemplary embodiment. Placket truss 220 is similar to the second embodiment described above with respect to FIGS. 9 and 10. In this case, however, slots 240 and 242 are relatively shallow and may be considered notches.

Figure 13:
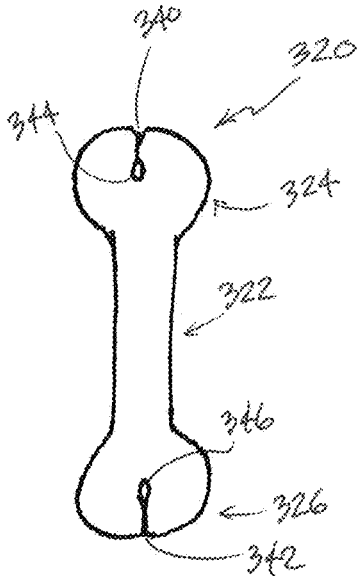
FIG. 13 is a top plan view of a placket truss according to a fourth exemplary embodiment.
Figure 14:
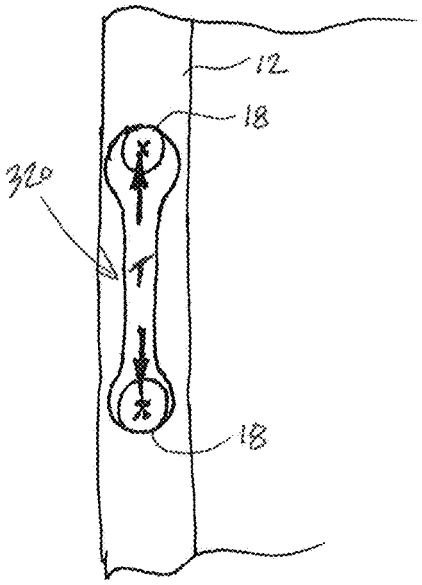
FIG. 14 is a top plan view of an inner placket with the placket truss of FIG. 13 installed on the placket.

FIG. 13 illustrates a placket truss 320 according to a fourth exemplary embodiment. Placket truss 320 includes an elongate member 322 with opposed end portions 324 and 326. Each end portion includes a slot 340, 342 that extends in the same direction as the length of the elongate member 322. However, slots 340, 342 may alternatively extend transversely to the length of elongate member 322. In this case each slot 340 and 342 includes a teardrop shaped root 344 and 346, respectively, to accommodate thread 17. FIG. 14 illustrates placket truss 320 installed on the front side of inner placket 12 with slots 340 and 342 engaging threads 17. Placket truss 320 provides tension along arrows T, which resists pulling force A described above. It should be appreciated that, in this case, placket truss 320 does not include clips. Accordingly, tension T is provided by engaging threads 17. Although placket truss 320 is shown with a single slot on both ends, a plurality of slots of different lengths may be disposed on each end to accommodate different button spacings and placket widths. It is contemplated that in this embodiment, placket truss 320 comprises a clear plastic material. Other suitable materials, however, may be used as appropriate.

Figure 15:
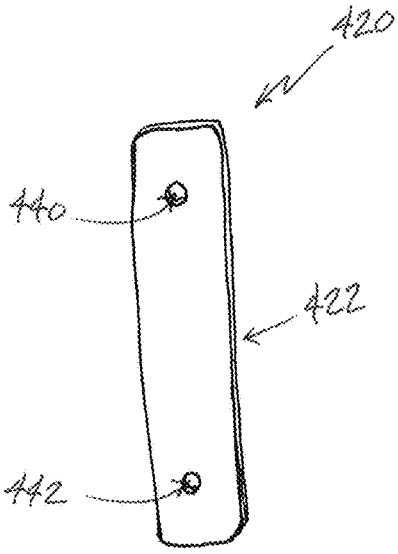
FIG. 15 is a perspective view of a placket truss according to a fifth exemplary embodiment.
Figure 16:
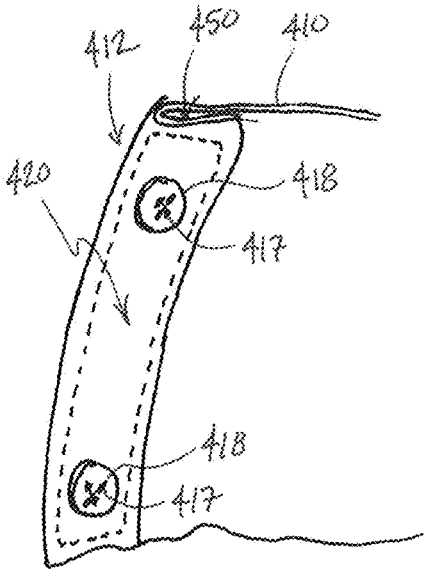
FIG. 16 is a perspective view of an inner placket illustrating the placket truss of FIG. 15 installed in the placket.

FIG. 15 illustrates a placket truss 420 according to a fifth exemplary embodiment which is designed to be embedded into the placket 412 of a garment 410, as shown in FIG. 16. Placket truss 420 includes an elongate member 422 and may also include clearance holes, or apertures, 440 and 442 through which thread 417 can extend. Placket truss 420 is comprised of a flat material that is flexible yet resilient, such as plastic. Preferably, the material used to construct placket truss 420 is washing machine and dryer safe. Placket 420 is installed in space 450 that may be created by folding a flap of material 410 over onto itself. Buttons 418 may be sewn to the placket 412 with thread 417 through holes 440 and 442, for example. Placket truss 420 may extend between a pair of buttons or a plurality of buttons. Moreover, placket truss 420 may be inserted into a sleeve included on the backside of inner placket 412.

Figure 17:
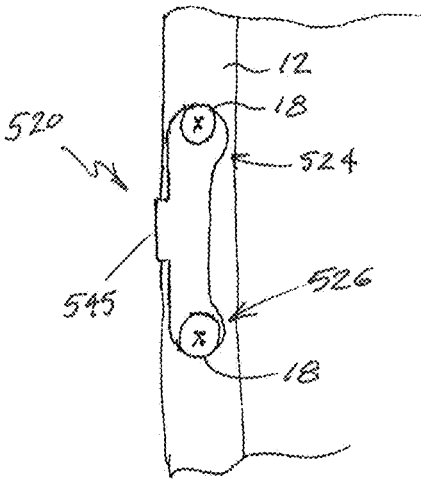
FIG. 17 is a perspective view of a placket truss according to a sixth exemplary embodiment.
Figure 18:
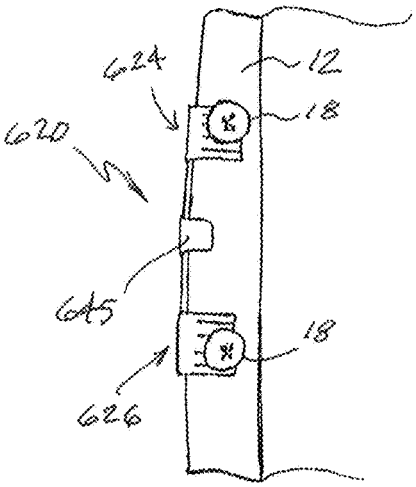
FIG. 18 is a perspective view of a placket truss according to a seventh exemplary embodiment.
Figure 19:
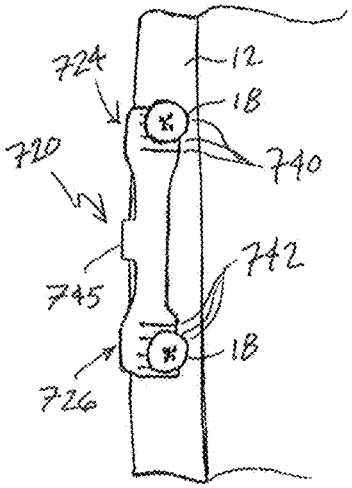
FIG. 19 is a perspective view of a placket truss according to an eighth exemplary embodiment.

FIGS. 17 and 18 illustrate placket truss 520 and 620, respectively, that are similar to the placket trusses described above, however, they include an additional clip (545, 645) operative to engage, or grasp, placket 12 along a medial portion of the elongate member approximately midway between buttons 18. FIG. 19 illustrates placket truss 720 according to an eighth exemplary embodiment, which is similar to the sixth embodiment shown in FIG. 17. In this case, however, each end portion 724, 726 includes a plurality of transversely extending slots 740, 742. While the above disclosed embodiments are shown to engage two buttons, multiple buttons may be engaged according to the present technology as desired.

Methods relating to the above described placket truss are also contemplated. The methods thus encompass the steps inherent in the above described mechanical structures and operation thereof. Broadly, one method could include grasping the placket and engaging the threads of adjacent buttons and resiliently maintaining the buttons at a desired distance. A method could further include supporting the backside of the inner placket relative to the buttons. Furthermore, a method could also include grasping the placket approximately midway between adjacent buttons.

Although the technology and methods of using and/or applying the same have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. A placket truss for use on a placket having a plurality of buttons sewn thereto with thread, said placket truss comprising:

an elongate member including opposed end portions;

a medial clip integral with the elongate member and disposed between said opposed end portions, said medial clip including a bend whereby the medial clip doubles back onto the elongate member and extends in a direction transverse to a length of the elongate member; and wherein each said end portion includes at least one slot sized and adapted to engage the thread of a corresponding button.

2. The placket truss of claim 1, wherein said at least one slot extends in the same direction as a length of said elongate member.

3. The placket truss of claim 1, wherein said at least one slot extends in a direction transverse to a length of said elongate member.

4. The placket truss of claim 1, wherein each said end portion includes a clip and wherein each said clip includes at least one slot.

5. The placket truss of claim 4, wherein said placket having a front side with the plurality of buttons sewn thereto and a back side, said elongate member adapted to confront the back side of the placket, and each said clip adapted to confront the front side of the placket whereby each said clip is capable of grasping the placket.

6. The placket truss of claim 4, wherein each said at least one slot extends in the same direction as a length of said elongate member.

7. The placket truss of claim 4, wherein each said at least one slot extends in a direction transverse to a length of said elongate member.

8. The placket truss of claim 7, wherein at least one said clip includes a plurality of slots.

9. The placket truss of claim 8, wherein a first said clip includes a first set of slots spaced apart from each other a selected first pitch and a second said clip includes a second set of slots spaced apart from each other a selected second pitch.

10. A placket truss for use on a placket having a front side with a plurality of buttons sewn thereto with thread, and a back side, said placket truss comprising:

an elongate member including opposed end portions, said elongate member configured to confront the back side of the placket;

each said end portion including a clip integral with the elongate member and confronting the front side of the placket; and wherein each said clip includes a bend whereby the clip doubles back onto the elongate member extending in a direction transverse to a length of the elongate member and at least one slot sized and adapted to engage the thread of a corresponding button.

11. The placket truss of claim 10, wherein said placket having a front side with the plurality of buttons sewn thereto and a back side, said elongate member adapted to confront the back side of the placket, and each said clip adapted to confront the front side of the placket whereby each said clip is capable of grasping the placket.

12. The placket truss of claim 10, wherein said at least one slot extends in a direction transverse to a length of said elongate member.

13. The placket truss of claim 12, wherein one said clip includes a first set of slots spaced apart from each other a selected first pitch and the other said clip includes a second set of slots spaced apart from each other a selected second pitch.

14. The placket truss of claim 13, wherein said first pitch is the same as said second pitch.

15. The placket truss of claim 10, wherein said elongate member comprises a strip of resilient material.

16. The placket truss of claim 15, wherein said elongate member is substantially flat.

17. The placket truss of claim 10, further comprising a medial clip disposed between said opposed end portions.

18. The placket truss of claim 10, wherein at least one said slot includes at least one notch adapted to receive the thread of a corresponding button.

19. A placket truss for use on a placket having a front side with a plurality of buttons sewn thereto with thread, and a back side, said placket truss comprising:

A substantially flat, resilient, elongate member including opposed end portions, said elongate member adapted to confront the back side of the placket;

each said end portion including a clip integral with the elongate member and adapted to confront the front side of the placket with a substantially flat portion that extends in a direction transverse to a length of the elongate member, whereby each said clip is capable of grasping the placket; and wherein one said clip includes a first set of slots spaced apart from each other a selected first pitch and the other said clip includes a second set of slots parallel to the first set of slots and spaced apart from each other a selected second pitch, each said slot extending in a direction transverse to a length of said elongate member.

* * * * *